US009199369B2

(12) United States Patent
Kristen et al.

(10) Patent No.: US 9,199,369 B2
(45) Date of Patent: Dec. 1, 2015

(54) PNEUMATIC STRIKING MECHANISM AND HAND-HELD POWER TOOL

(75) Inventors: Ferdinand Kristen, Gilching (DE); Stefan Hammerstingl, Munich (DE); Erwin Manschitz, Germering (DE); Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 984 days.

(21) Appl. No.: 12/799,184

(22) Filed: Apr. 19, 2010

(65) Prior Publication Data

US 2010/0263894 A1 Oct. 21, 2010

(30) Foreign Application Priority Data

Apr. 20, 2009 (DE) ..... 10 2009 002 474

(51) Int. Cl.

| | |
|---|---|
| ***B25D 11/06*** | (2006.01) |
| ***B25D 17/00*** | (2006.01) |
| ***B25D 9/04*** | (2006.01) |
| ***B25D 17/06*** | (2006.01) |

(52) U.S. Cl.

CPC ..... *B25D 17/06* (2013.01); *B25D 2211/003* (2013.01); *B25D 2211/068* (2013.01); *B25D 2217/0019* (2013.01); *B25D 2217/0023* (2013.01); *B25D 2222/54* (2013.01)

(58) Field of Classification Search

CPC ..... B25D 17/00; B25D 9/04; B25D 2222/54; B25D 11/06

USPC ..... 173/200–201, 217, 47–48; 428/36.9, 428/36.91

See application file for complete search history.

(56) References Cited

U.S. PATENT DOCUMENTS

| | | | | |
|---|---|---|---|---|
| 4,388,776 | A * | 6/1983 | Spring | 446/197 |
| 4,476,941 | A | 10/1984 | Buck et al. | 173/117 |
| 4,602,689 | A | 7/1986 | Wanner | 173/127 |
| 4,738,339 | A * | 4/1988 | Taylor | 188/322.19 |
| 5,348,425 | A * | 9/1994 | Heiliger | 405/297 |
| 6,395,359 | B1 * | 5/2002 | McGrath et al. | 428/36.91 |
| 6,726,994 | B1 * | 4/2004 | Araki et al. | 428/411.1 |
| 2008/0236855 | A1 | 10/2008 | Meixner et al. | 173/201 |

FOREIGN PATENT DOCUMENTS

| | | | |
|---|---|---|---|
| DE | 29 45 935 | A1 | 5/1981 |
| DE | 198 28 423 | C2 | 1/2000 |
| DE | 10 2005 021 734 | A1 | 11/2006 |
| EP | 1 027 964 | A2 | 8/2000 |
| GB | 1 246 357 | | 9/1971 |
| GB | 2 063 141 | A | 6/1981 |
| GB | 2063141 | A | 6/1981 |
| JP | 2005 193 354 | | 7/2005 |
| WO | WO 2008/094134 | A2 | 8/2008 |

* cited by examiner

*Primary Examiner* — Michelle Lopez

(74) *Attorney, Agent, or Firm* — Davidson, Davidson & Kappel, LLC

(57) ABSTRACT

A pneumatic striking mechanism includes a guide cylinder in which a freely moving piston and an exciter piston are arranged movably along a striking axis. The guide cylinder has a plastic. The striking mechanism includes a pneumatic chamber sealed off by the guide cylinder, by the freely moving piston and by the exciter piston, as well as a drive for periodically moving the exciter piston, as a result of which the freely moving piston is excited to execute a periodical movement between the striking surface and the exciter piston.

1 Claim, 1 Drawing Sheet

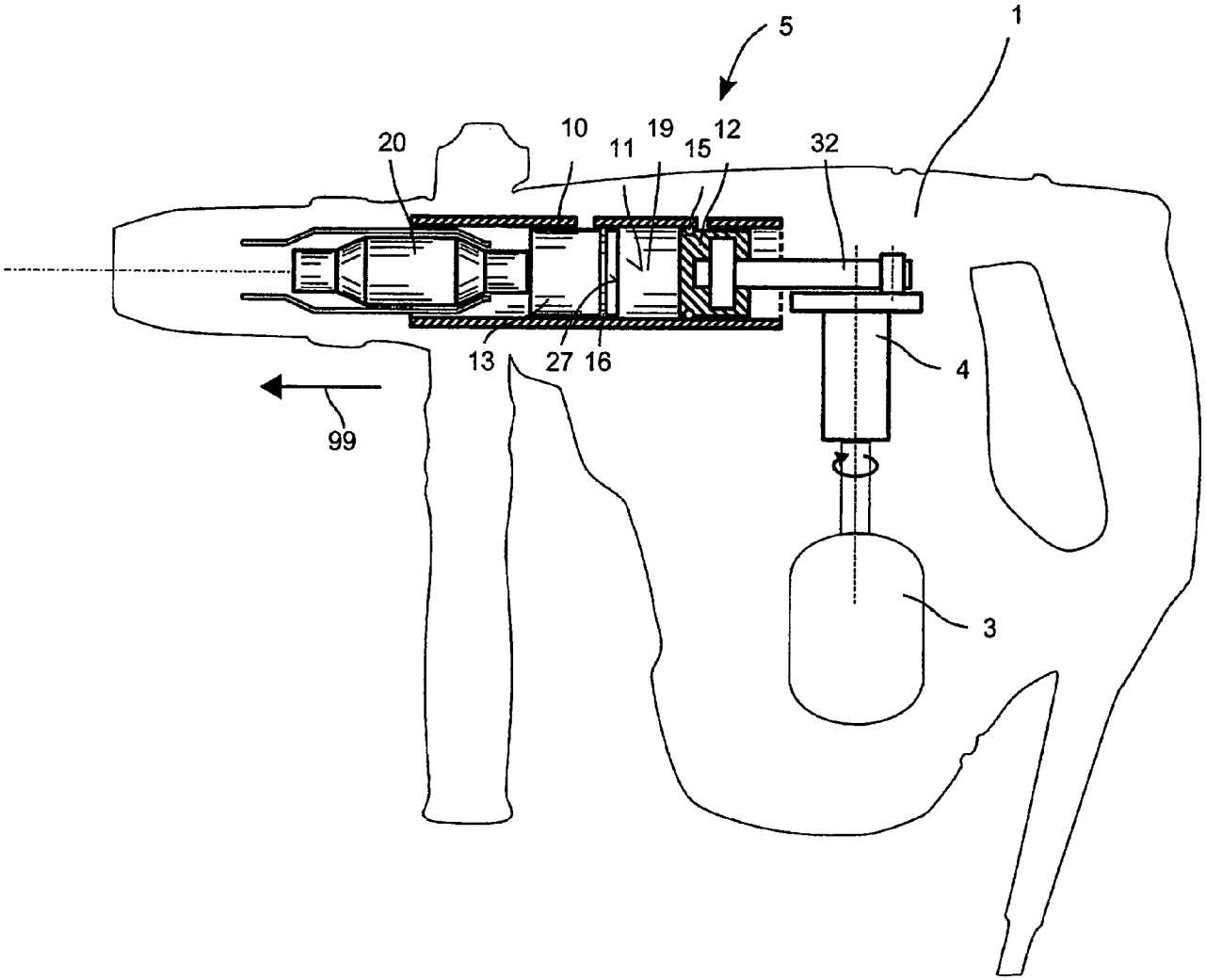
1
5
32
12
15
19
11
10
20
4
16
27
13
3
99

PNEUMATIC STRIKING MECHANISM AND HAND-HELD POWER TOOL

This claims the benefit of German Patent Application DE 10 2009 002 474.3, filed Apr. 20, 2009 and hereby incorporated by reference herein.

The present invention relates to a pneumatic striking mechanism and to a hand-held power tool having a pneumatic striking mechanism.

BACKGROUND

U.S. Pat. No. 4,602,689 describes a hand-held power tool having a pneumatic striking mechanism. A freely moving piston that is excited by a driven exciter piston to execute a periodical movement is arranged in a guide cylinder. The guide cylinder is sheathed with a thermally insulating plastic layer in order to reduce heat losses from an air cushion situated between the exciter piston and the freely moving piston. Moreover, the freely moving piston has a jacket made of plastic in order to improve the thermal insulation. The core of the freely moving piston is made of metal so that it can withstand the mechanical loads. The guide cylinder is made of metal for the same reason.

SUMMARY OF THE INVENTION

An object of the present invention is reducing the total weight of a striking mechanism.

The present invention provides a pneumatic striking mechanism including a guide cylinder in which a freely moving piston and an exciter piston are arranged movably along a striking axis. The guide cylinder has a plastic. The striking mechanism comprises a pneumatic chamber sealed off by the guide cylinder, by the freely moving piston and by the exciter piston, as well as a drive for periodically moving the exciter piston, as a result of which the freely moving piston is excited to execute a periodical movement between the striking surface and the exciter piston.

Even though the moving parts in pneumatic striking mechanisms, for instance, also that of British patent GB 1 246 357, have been made of plastic, at least partially, for quite some time now, it was assumed that the guide tube had to be made of metal. In this context, GB 1 246 357 refers especially to the longer relaxation duration that is inherent to plastics and that restricts their use.

In contrast, it has been recognized that a guide tube that is partially made of plastic can withstand thermal and mechanical loads.

One embodiment provides for an inner wall of the guide cylinder to be made of plastic. This is particularly advantageous if the moving elements, namely, the freely moving piston and the exciter piston, are made of plastic, at least partially. The coefficients of thermal expansion are thus adapted to each other in a natural manner, and the relative dimensions of the elements are retained during operation. The guide cylinder can also be completely made of plastic.

A circumferential surface of the exciter piston and/or a circumferential surface of the freely moving piston can be made of another plastic. The plastic of the guide cylinder and the other plastic of the circumferential surfaces of the freely moving piston and/or exciter piston can be the same.

The plastic for an inner wall of the guide cylinder is preferably made of a thermoset plastic, for instance, from the class of amino plastics, phenol plastics and epoxy resins. The internal dimensions of the guide cylinder have to be made with a high degree of precision. The strength of the plastic can be increased by means of fillers such as, for example, glass beads or glass fibers. The fillers on the inner wall have to be completely covered by the plastic.

The guide cylinder can be made of several layers of plastic, whereby one layer for the inner wall of the guide cylinder is made of a thermoset plastic. The outer layers can advantageously be made of thermoplastic materials. The multilayered structure of different plastics translates into a high degree of stiffness of the guide pipe owing to the thermoplastic materials. For reinforcement purposes, Teflon fibers can be incorporated into the layers made of thermoplastic material. Polyamides are an example of a suitable thermoplastic material.

BRIEF DESCRIPTION OF THE DRAWINGS

The description below explains the invention on the basis of examples of embodiments and figures. The FIGURE shows the following:

FIG. 1—a hand-held power tool.

Unless otherwise indicated, identical or functionally equivalent elements are labeled with the same reference numerals in the figures.

DETAILED DESCRIPTION

FIG. 1 shows a hammer drill 1 as an example of a hand-held power tool 1. A pneumatic striking mechanism 5 is arranged in the hand-held power tool, for example in a body of housing of the handheld power tool. The pneumatic striking mechanism 5 has a guide cylinder 10 in which an exciter piston 12 and a freely moving piston 13 are movably arranged. The exciter piston 12 and the freely moving piston 13 create an air-tight seal with an inner wall 11 of the guide cylinder 10. Additional gaskets 15 can be provided for this purpose. The guide cylinder 10, the exciter piston 12 and the freely moving piston 13 enclose a pneumatic chamber 19.

A drive 3, for example, an electric motor, is coupled to the exciter piston 12 via a shaft 4 and an eccentric drive 32. Driven by the drive 3, the exciter piston 12 executes a periodical back and forth movement in the guide cylinder 10. The freely moving piston 13 is excited to execute a periodical back and forth movement by means of the coupler via the pneumatic chamber 19 on the exciter piston 12.

In the embodiment of the hand-held power tool shown, a punch 20 is provided against which the freely moving piston 13 strikes. Instead of a punch 20, the freely moving piston 13 can also directly strike a tool that is inserted into the striking mechanism.

The guide cylinder 10 is made of a plastic. Preferably, the guide cylinder 10 is manufactured as a one-piece injection-molded part. As an alternative, the guide cylinder 10 can be milled out of a plastic block.

In another variant, it is provided that the guide cylinder 10 has an external skeleton made of metal while the inner wall is made of plastic. The external skeleton can be a hollow cylinder or a hollow cylinder provided with perforations.

Another embodiment provides for a metal mesh to be embedded into the plastic of the guide cylinder 10. The metal mesh increases the mechanical stability of the guide cylinder 10 without detrimentally affecting the thermal properties. Moreover, the metal mesh only slightly increases the weight.

The exciter piston 12 can be partially or completely made of plastic. Preferably, the circumferential surface of the cylindrical exciter piston 12 is made of plastic. Moreover, the surface of the exciter piston 12 facing the freely moving piston 13 can be made of plastic.

The freely moving piston 13 preferably has a solid core made of metal that defines the weight of the freely moving piston 13. A circumferential surface of the cylindrical freely moving piston 13 and/or a surface facing the exciter piston 12 can be made of plastic.

What is claimed is:

1. A pneumatic striking mechanism comprising:

a guide cylinder;

a freely moving piston and an exciter piston arranged movably in the guide cylinder along a striking axis;

a pneumatic chamber sealed off by the guide cylinder, the freely moving piston and the exciter piston; and a drive for periodically moving the exciter piston so that the freely moving piston is excited to execute a periodical movement between a striking surface and the exciter piston;

the guide cylinder including a plastic, wherein the guide cylinder has at least one layer made of a thermoset plastic and at least one layer of a thermoplastic, wherein an innermost layer of the at least one layer that defines an inner surface is made of a thermoset plastic.

* * * * *